US005733204A

United States Patent [19]

Carrara

[11] Patent Number: 5,733,204

[45] Date of Patent: Mar. 31, 1998

[54] FLEX TOP PUTTER GRIP

[76] Inventor: Louis Carrara, 772 Terni La., Santa Barbara, Calif. 93105

[21] Appl. No.: 730,904

[22] Filed: Oct. 18, 1996

[51] Int. Cl.[6] ..... A63B 53/14

[52] U.S. Cl. ..... 473/300; 473/204

[58] Field of Search ..... 473/204–300, 473/301–303

[56] References Cited

U.S. PATENT DOCUMENTS

| | | | |
|---|---|---|---|
| 1,201,728 | 10/1916 | Henry et al. | 473/204 |
| 3,109,653 | 11/1963 | Biggs | 473/204 |
| 5,133,555 | 7/1992 | Bailey | 473/300 |
| 5,374,064 | 12/1994 | Barber | 473/204 |
| 5,398,930 | 3/1995 | Gibson | 473/300 |
| 5,454,564 | 10/1995 | Kronogard | 473/300 |

*Primary Examiner*—Mark S. Graham

[57] ABSTRACT

A flex top putter grip for use in association with a golf club, the apparatus comprises a golf club grip fabricated of semi-rigid elastomeric materials including a top, a bottom, a front surface, a rear surface and two side surfaces, the side surfaces having an upper region and a lower region, the upper region having a lower extent, the top having a width that is 50% larger than the width of the bottom, the grip including a device to allow flexion of the grip in a horizontal plane; and a central bore being positioned within the bottom and being adapted to receive a golf club, in an operative orientation a user positioning a golf club within the central bore and swinging it, the grip flexing with the motion of the swing permitting the user to swing straight.

6 Claims, 2 Drawing Sheets

FLEX TOP PUTTER GRIP

BACKGROUND OF THE INVENTION

1. Field of the Invention

The present invention relates to a flex top putter grip and more particularly pertains to allowing flexion of the golf club during a swing.

2. Description of the Prior Art

The use of golf club grips is known in the prior art. More specifically, golf club grips heretofore devised and utilized for the purpose of grasping a golf club are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,310,158 to Hoffman discloses a golf club and grip therefore.

U.S. Pat. No. 5,087,042 to Solheim discloses a golf club grip.

U.S. Pat. No. 5,398,934 to Soong discloses a golf club and grip therefore.

U.S. Pat. No. 5,398,930 to Gibson discloses a golf grip.

U.S. Pat. No. 4,890,837 to Keeler discloses a golf putter.

U.S. Pat. No. Des. 355,444 to Deluca discloses a golf club grip.

While these devices fulfill their respective, particular objective and requirements, the aforementioned patents do not describe a flex top putter grip for allowing flexion of the golf club during a swing.

In this respect, the flex top putter grip according to the present invention substantially departs from the conventional concepts and designs of the prior art, and in doing so provides an apparatus primarily developed for the purpose of allowing flexion of the golf club during a swing.

Therefore, it can be appreciated that there exists a continuing need for new and improved flex top putter grip which can be used for allowing flexion of the golf club during a swing. In this regard, the present invention substantially fulfills this need.

SUMMARY OF THE INVENTION

In the view of the foregoing disadvantages inherent in the known types of golf club grips now present in the prior art, the present invention provides an improved flex top putter grip. As such, the general purpose of the present invention, which will be described subsequently in greater detail, is to provide a new and improved flex top putter grip and method which has all the advantages of the prior art and none of the disadvantages.

To attain this, the present invention essentially comprises a new and improved flex top putter grip for use in association with a golf club, the apparatus comprising, in combination: a golf club grip fabricated of semi-rigid rubber and formed in an elongated generally rectangular configuration including a top, a bottom, a front surface, a rear surface and two side surfaces, the grip including four rounded side edges, the front and side surfaces of the grip being planar, the rear surface of the grip being rounded, the side surfaces having an upper region and a lower region, the upper region having a lower extent, the length of the upper region being between 2½ and 3 inches, the length of the lower region being between 7 and 7½ inches, the top having a width that is 50% larger than the width of the bottom, each of the side surfaces including three ribs formed therein, the ribs being positioned at the lower extent of the upper region, the ribs allowing flexion of the grip in a horizontal plane; and a central bore being positioned within the bottom and being adapted to receive a golf club, the central bore having a length essentially identical to the length of the lower region, the central bore having a diameter that is about 70% the width of the bottom, in an operative orientation a user positioning a golf club within the central bore and swinging it, the grip flexing with the motion of the swing permitting the user to swing straight.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved flex top putter grip which has all the advantages of the prior art golf club grips and none of the disadvantages.

It is another object of the present invention to provide a new and improved flex top putter grip which may be easily and efficiently manufactured and marketed.

It is a further object of the present invention to provide a new and improved flex top putter grip which is of durable and reliable construction.

An even further object of the present invention is to provide a new and improved flex top putter grip which is susceptible of a low cost of manufacture with regard to both materials and labor, and which accordingly is then susceptible of low prices of sale to the consuming public, thereby making such a flex top putter grip economically available to the buying public.

Even still another object of the present invention is to provide a new and improved flex top putter grip for allowing flexion of the golf club during a swing.

Lastly, it is an object of the present invention to provide a new and improved flex top putter grip for use in association with a golf club, the apparatus comprises a golf club grip fabricated of semi-rigid elastomeric materials including a top, a bottom, a front surface, a rear surface and two side surfaces, the side surfaces having an upper region and a lower region, the upper region having a lower extent, the top having a width that is 50% larger than the width of the bottom, the grip including a device to allow flexion of the grip in a horizontal plane; and a central bore being positioned within the bottom and being adapted to receive a golf club, in an operative orientation a user positioning a golf club within the central bore and swinging it, the grip flexing with the motion of the swing permitting the user to swing straight.

Once placed onto a golf club, such as a putter, the present invention would enable the golfer more flexible movement and balance when making a shot. In turn, this would help the golfer in making a more accurate shot. In addition, any other optional methods of flexing could be used with the present invention. The present invention would work in the following manner. While holding the two and one half inch or three inch flex top of the putter (which would be made from solid material, running from the shaft to the top portion of the grip), the golfer would grip with his or her left hand and, at the same time, compress his or her forearm to the body for a firm support (as used with the long putter). He or she would then use the right hand to dynamically cause the putter to strike the ball, directing it toward the hole with greater accuracy. When the present invention is held with the left hand firmly to the body, the present invention would take shoulder movement and the left hand out of play, allowing the ball to move on a straight line for a better score. In other words, the present invention would work to keep the golfer's body movement to a minimum, while using a one-hand putting method.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
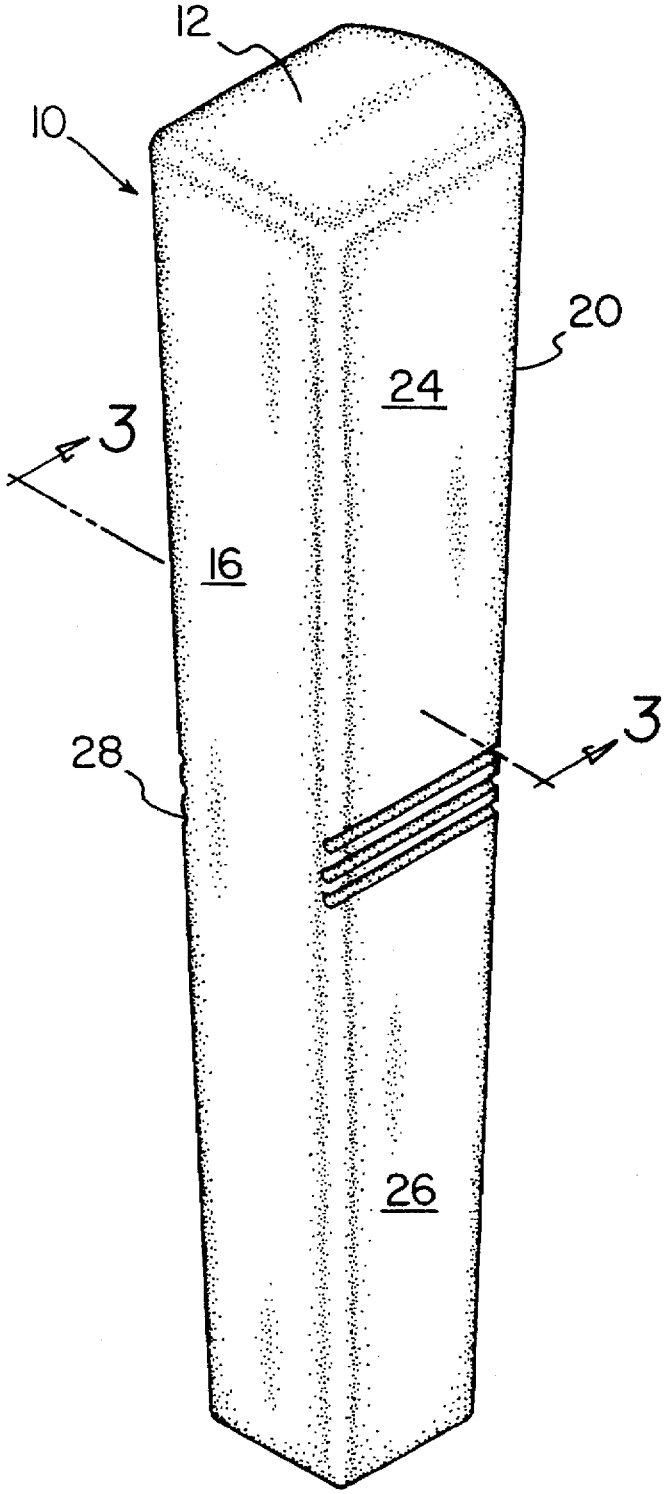
FIG. 1 is a perspective view of the preferred embodiment of the flex top putter grip constructed in accordance with the principles of the present invention.
Figure 2:
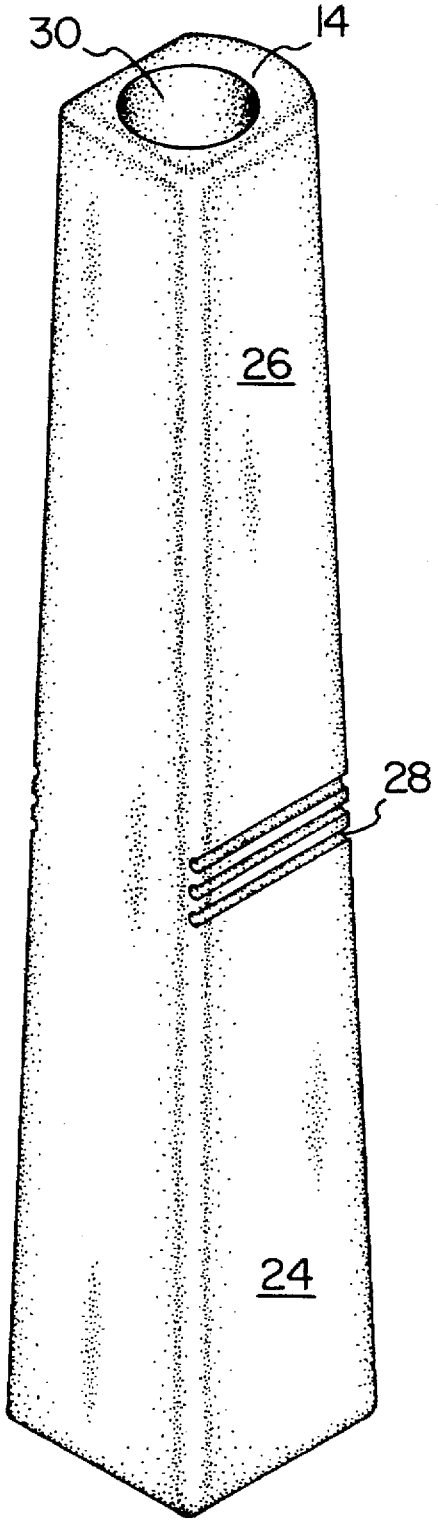
FIG. 2 is a perspective view of the surfaces of the apparatus illustrating the central bore.

With reference now to the drawings, and in particular, to FIG. 1 thereof, the preferred embodiment of the new and improved flex top putter grip embodying the principles and concepts of the present invention and generally designated by the reference number 10 will be described.

Specifically, it will be noted in the various Figures that the device relates to a new and improved flex top putter grip 10. In its broadest context, the device consists of a top surface 12, a bottom surface 14, a front surface 16 and a rear surface. Such components are individually configured and correlated with respect to each other so as to attain the desired objective.

The present invention is used in association with a golf club. In the preferred embodiment of the apparatus, the golf club is a putter. In alternative embodiments of the apparatus, the grip may be used with another club, such as a chipper. A chipper, or chippo, as they are known is an iron which resembles a putter but has a wedged blade instead for chipping a ball onto the green from the fringe where the grass may not be puttable. Hence, the present invention can be used with a putter or a specified chipping iron around the greens and with the long shaft putter. Golf clubs are fabricated with a stock diameter. This apparatus is fabricated for use in association with a club with a stock diameter. Note FIG. 1.

Figure 3:
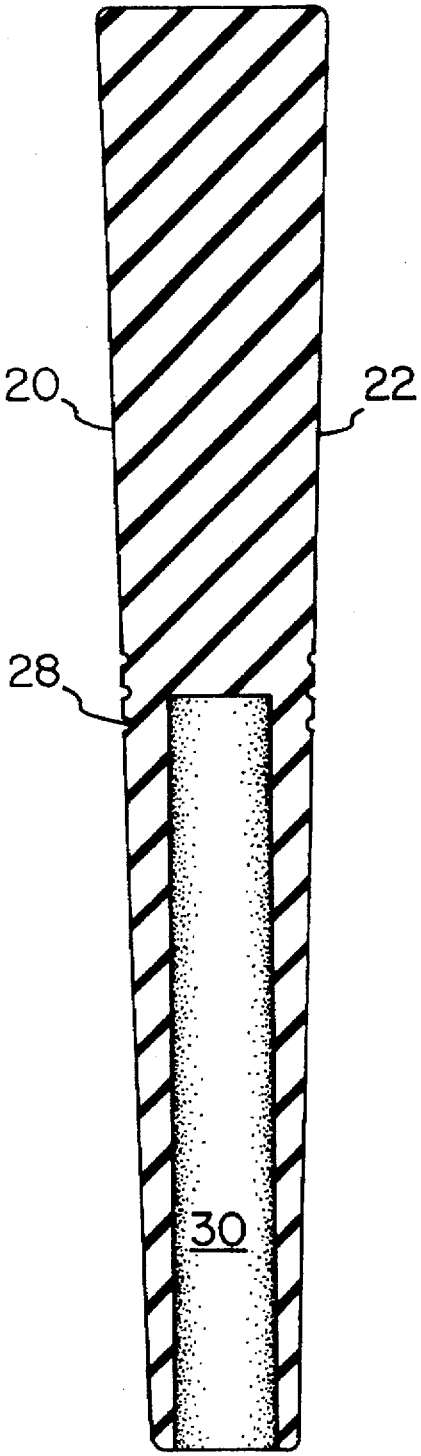
FIG. 3 is a cross sectional view of the apparatus taken along section line 3—3 of FIG. 1.
Figure 4:
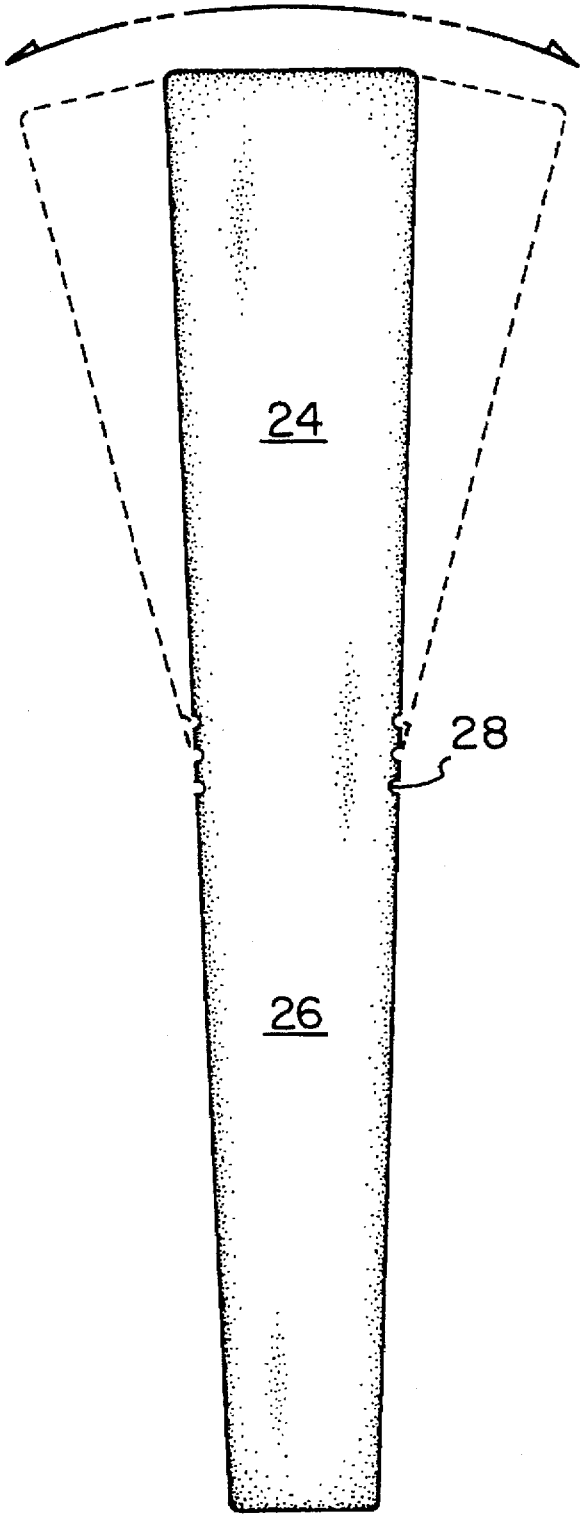
FIG. 4 is a side perspective view of the apparatus illustrating the flexion of the grip.

The golf club grip 10 is fabricated of semi-rigid rubber and formed in an elongated generally rectangular configuration including a top 12, a bottom 14, a front surface 16, a rear surface and two side surfaces 20, 22. The grip includes four rounded side edges. The front and side surfaces of the grip are planar. The rear surface of the grip is rounded. This configuration allows a user to comfortably grasp the grip. The side surfaces have an upper region 24 and a lower region 26. The upper region has a lower extent. In the primary embodiment of the apparatus the length of the upper region is between 2½ and 3 inches. The length of the lower region is between 7 and 7½ inches. In alternative embodiments the grip is formed in a variety of shapes and sizes. The top has a width that is 50% larger than the width of the bottom. Each of the side surfaces includes three ribs 28. The ribs are positioned at the lower extent of the upper region. The ribs allow flexion of the grip in a horizontal plane. Note FIGS. 3 and 4.

A central bore 30 is positioned within the bottom and is adapted to receive a golf club. In the primary embodiment of the apparatus the bore is adapted to receive a putter. The central bore has a length essentially identical to the length of the lower region. The central bore has a diameter that is about 70% of the width of the bottom. In an operative orientation, a user positions a golf club within the central bore and swings it. The grip flexes with the motion of the swing permitting the user to swing straight. The grip removes the shoulder movement that gets transferred during the swing. This prevents any unwanted angular movement to be transmitted to the swing. Therefore, the user's shot is straight, although his swing might not be. Note FIG. 3 and 4.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved flex top putter grip for use in association with a golf club, the apparatus comprising, in combination:

a golf club grip fabricated of semi-rigid rubber and formed in an elongated generally rectangular configuration including a top, a bottom, a front surface, a rear surface and two side surfaces, the grip including four rounded side edges, the front and side surfaces of the grip being planar, the rear surface of the grip being rounded, the side surfaces having an upper region and a lower region, the upper region having a lower extent, the length of the upper region being between 2 ½ and 3 inches, the length of the lower region being between 7 and 7 ½ inches, the top having a width that is 50% larger than the width of the bottom, each of the side surfaces including three ribs formed therein, the ribs being positioned at the lower extent of the upper region, the ribs allowing flexion of the grip in a horizontal plane; and a central bore being positioned within the bottom and being adapted to receive a golf club, the central bore having a length essentially identical to the length of the lower region, the central bore having a diameter that is about 70% the width of the bottom, in an operative orientation a user positioning a golf club within the central bore and swinging it, the grip flexing with the motion of the swing permitting the user to swing straight.

2. A flexible golf club grip for use in association with a golf club, the apparatus comprising:

a golf club grip fabricated of a semi-rigid elastomeric materials including a top, a bottom, a front surface, a rear surface and two side surfaces, the side surfaces having an upper region and a lower region, the upper region having a lower extent, the top having a width that is between 25% and 75% larger than the width of the bottom, the grip including means to allow flexion of the grip in a horizontal plane, wherein the means to allow flexion of the grip includes three ribs formed on each of the side surfaces, the ribs being positioned at the lower extent of the upper region; and a central bore being positioned within the bottom and being adapted to receive a golf club, in an operative orientation a user positioning a golf club within the central bore and swinging it, the grip flexing with the motion of the swing permitting the user to swing straight.

3. The flexible golf club grip as set forth in claim 2 wherein the grip is formed in an elongated generally rectangular configuration, the grip including four rounded side edges, the front and side surfaces of the grip being planar, the rear surface of the grip being rounded.

4. The flexible golf club grip as set forth in claim 2 wherein the length of the upper region is between 2 ½ and 3 inches, the length of the lower region being between 7 and 7 ½ inches, the central bore having a length essentially identical to the length of the lower region, the central bore having a diameter that is about 70% of the width of the bottom.

5. The flex top putter grip as set forth in claim 4 wherein the central bore is adapted to receive a putter.

6. The flex top putter grip as set forth in claim 3 wherein the central bore is adapted to receive a chipper.

* * * * *